US007831168B2

(12) United States Patent
Allen et al.

(10) Patent No.: US 7,831,168 B2
(45) Date of Patent: Nov. 9, 2010

(54) IMAGING UNITS AND METHODS OF INSERTION INTO AN IMAGE FORMING DEVICE

(75) Inventors: Eugene David Allen, Richmond, KY (US); Jarrett Clark Gayne, Lexington, KY (US); Darin Michael Gettelfinger, Lexington, KY (US); Paul Douglas Horrall, Lexington, KY (US); Daniel Craig Hutchens, Georgetown, KY (US)

(73) Assignee: Lexmark International, Inc., Lexington, KY (US)

( * ) Notice: Subject to any disclaimer, the term of this patent is extended or adjusted under 35 U.S.C. 154(b) by 658 days.

(21) Appl. No.: 11/686,614

(22) Filed: Mar. 15, 2007

(65) Prior Publication Data

US 2008/0226331 A1 Sep. 18, 2008

(51) Int. Cl.
*G03G 15/00* (2006.01)

(52) U.S. Cl. ..... 399/90; 399/27; 399/107; 399/110; 399/111; 399/119

(58) Field of Classification Search ..... 399/12, 399/27, 90, 107, 110, 111, 112, 119; 222/DIG. 1
See application file for complete search history.

(56) References Cited

U.S. PATENT DOCUMENTS 6,101,349 A * 8/2000 Ohashi et al. ..... 399/110
6,198,891 B1 * 3/2001 Ishida et al. ..... 399/117
6,463,235 B1 * 10/2002 Yamanaka et al. ..... 399/117
6,970,665 B2 * 11/2005 Kuma et al. ..... 399/90
2003/0161656 A1 * 8/2003 Miura et al. ..... 399/116
2004/0022556 A1 * 2/2004 Nomura ..... 399/116
2008/0226351 A1 * 9/2008 Dawson et al. ..... 399/254

FOREIGN PATENT DOCUMENTS

JP 10133534 A * 5/1998

* cited by examiner

*Primary Examiner*—David M Gray
*Assistant Examiner*—G. M. Hyder

(57) ABSTRACT

The present application is directed to an imaging unit for an image forming device. In one embodiment, the imaging unit includes a frame that includes brace members that are connected together to form a central opening. The imaging unit may also include separate mounting locations positioned on the frame in a side-by-side orientation. Each of the mounting locations may be adapted to receive a imaging unit and position a PC member of the imaging unit. The frame may also include locating features to align the frame within the image forming device. Electrical contacts may be operatively connected to the frame. The electrical contacts may operatively connect with the image forming device to provide electrical communication to each of the plurality of imaging units.

6 Claims, 11 Drawing Sheets

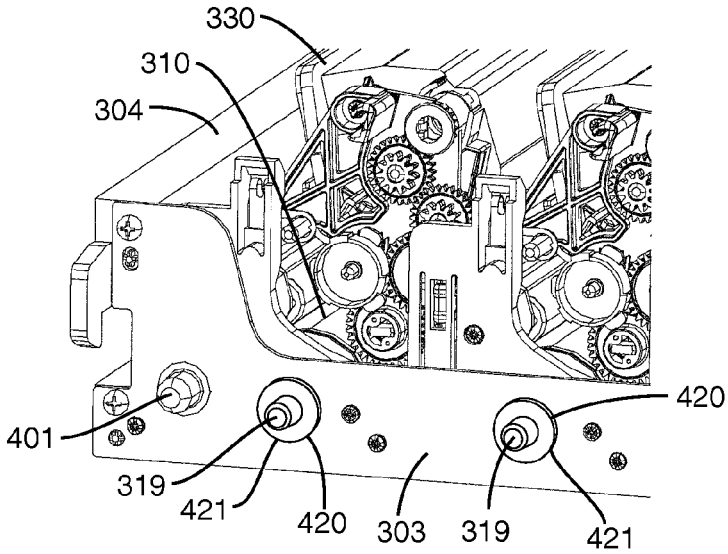
FIG. 7
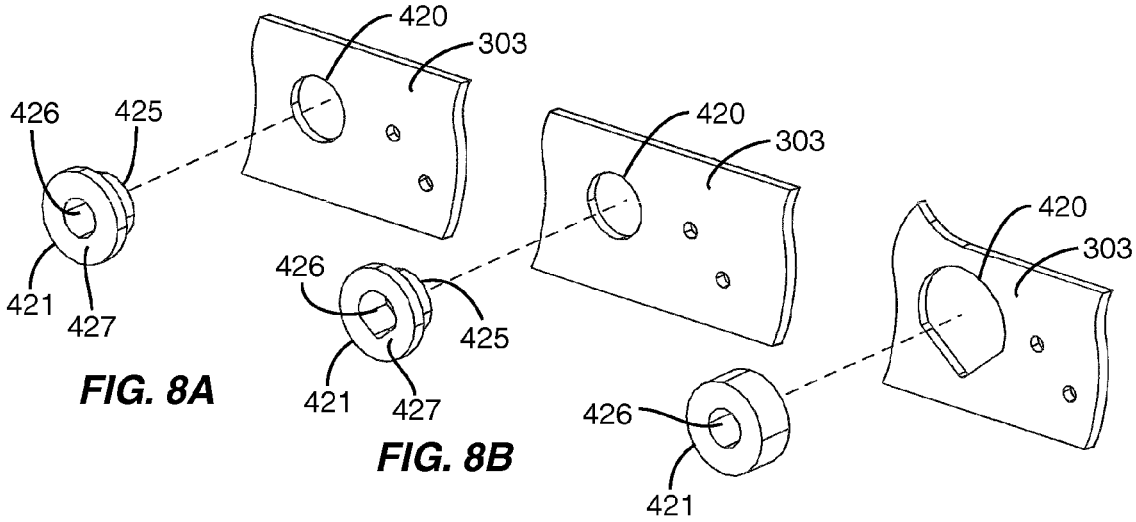
FIG. 8A
FIG. 8B
FIG. 8C

IMAGING UNITS AND METHODS OF INSERTION INTO AN IMAGE FORMING DEVICE

BACKGROUND

The present disclosure relates generally to imaging units and method of insertion into an image forming device and, more specifically, to imaging units that provide for accurate alignment within the image forming device and methods of accurately aligning the imaging units.

Image forming devices include copiers, laser printers, facsimile machines, and the like. These devices may include multiple imaging stations that are completely or partially removed and replaced when necessary. In particular, color devices may require up to four imaging stations. The imaging stations may include a developer unit, photoconductor unit, and a toner cartridge. The developer unit may include a developer roll, a doctor blade, and a toner adder roll. The photoconductor unit may include a photoconductive (PC) drum, charge roll, and PC drum cleaner. The toner cartridge may include a reservoir to contain the toner.

The toner is consumed during the image forming process whereby the amount of toner is reduced during each successive image forming process. Once all of the toner has been distributed, the user removes all or part of the imaging station and inserts a replacement. The imaging forming device and the imaging unit should be constructed to provide access to the imaging stations to facilitate the removal. Further, the device should provide for accurate replacement and realignment within the imaging unit and/or the image forming device.

Current imaging forming devices include imaging station designs with various negative aspects. In image forming devices that use multiple cartridges, each imaging station should be capable of being inserted into the image forming device, located, and electrically connected independently from the other stations. These stations may also require significantly more mechanical interfaces with the image forming device, including mechanical hold-downs, electrical contacts, guide rails, and datum surfaces. The independent stations may also require extra space within the interior of the image forming device to facilitate insertion and removal. This results in an increase in the overall size of the image forming device.

SUMMARY

The present application is directed to an imaging unit for an image forming device. In one embodiment, the imaging unit includes a frame that includes brace members that are connected together to form a central opening. The imaging unit may also include separate mounting locations positioned on the frame in a side-by-side orientation. Each of the mounting locations may be adapted to receive an imaging station that may include a developer unit, photoconductor unit, and a toner cartridge. The frame may also include locating features to align the frame within the image forming device. Electrical contacts may be operatively connected to the frame. The electrical contacts may operatively connect with the image forming device to provide electrical communication to each of the plurality of imaging stations.

BRIEF DESCRIPTION OF THE DRAWINGS

FIG. 7 is a partial perspective view of an imaging unit according to one embodiment.

FIG. 8A is a partial perspective view of the frame including an aperture and a bushing that fits within the aperture according to one embodiment.

FIG. 8B is a partial perspective view of the frame including an aperture and a bushing that fits within the aperture according to one embodiment.

FIG. 8C is a partial perspective view of the frame including an aperture and a bushing that fits within the aperture according to one embodiment.

DETAILED DESCRIPTION

Figure 1:
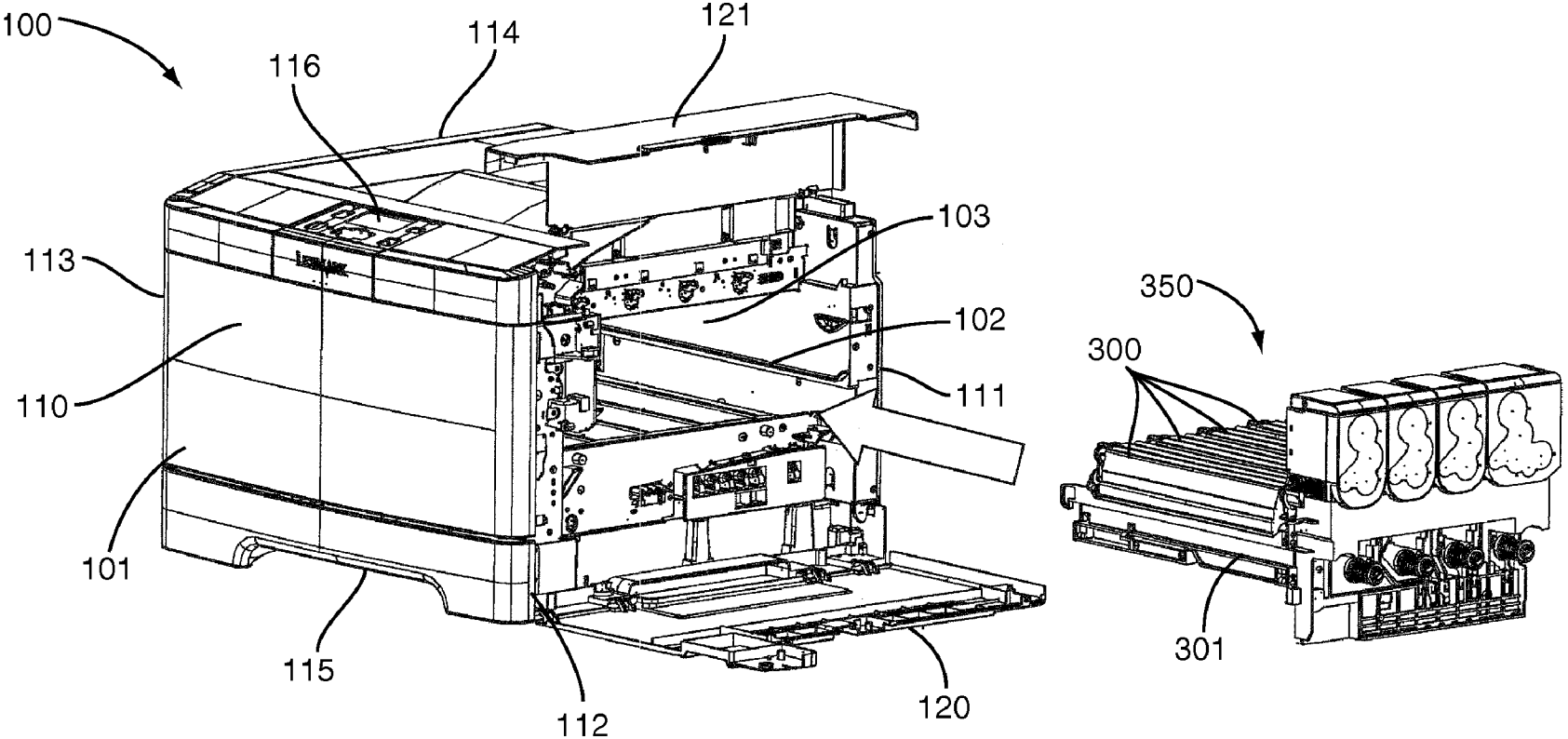
FIG. 1 is a perspective exploded view of an imaging unit and a body of an image forming device according to one embodiment.

The present application is directed to an imaging unit that is mounted within an image forming device. The imaging unit includes two or more separate imaging stations that are mounted together as a single element for insertion into the image forming device. FIG. 1 illustrates one embodiment with the imaging unit 350 that includes a frame 301 for receiving a number of imaging stations 300. The imaging unit 350 fits within an opening in the body 101 of the image forming device 100 with the frame 301 being positioned on one or more guides 102. The imaging unit accurately places the imaging stations 300 within the interior of the body 101, and may also be more space efficient to allow for a smaller overall body 101.

As illustrated in FIG. 1, the image forming device 100 includes a body 101 with a front side 110, back side 111, lateral sides 112, 113, a top side 114, and a bottom 115. A control panel 116 may be positioned on the exterior and include various input mechanisms for operating the image forming device 100. A first door 120 is pivotably positioned across an opening that leads into an interior 103 of the body 101. A second 121 is positioned on the top side 114 of the body 101. Guide rails 102 are positioned within the interior 103 to receive and position the imaging unit 350.

Figure 2:
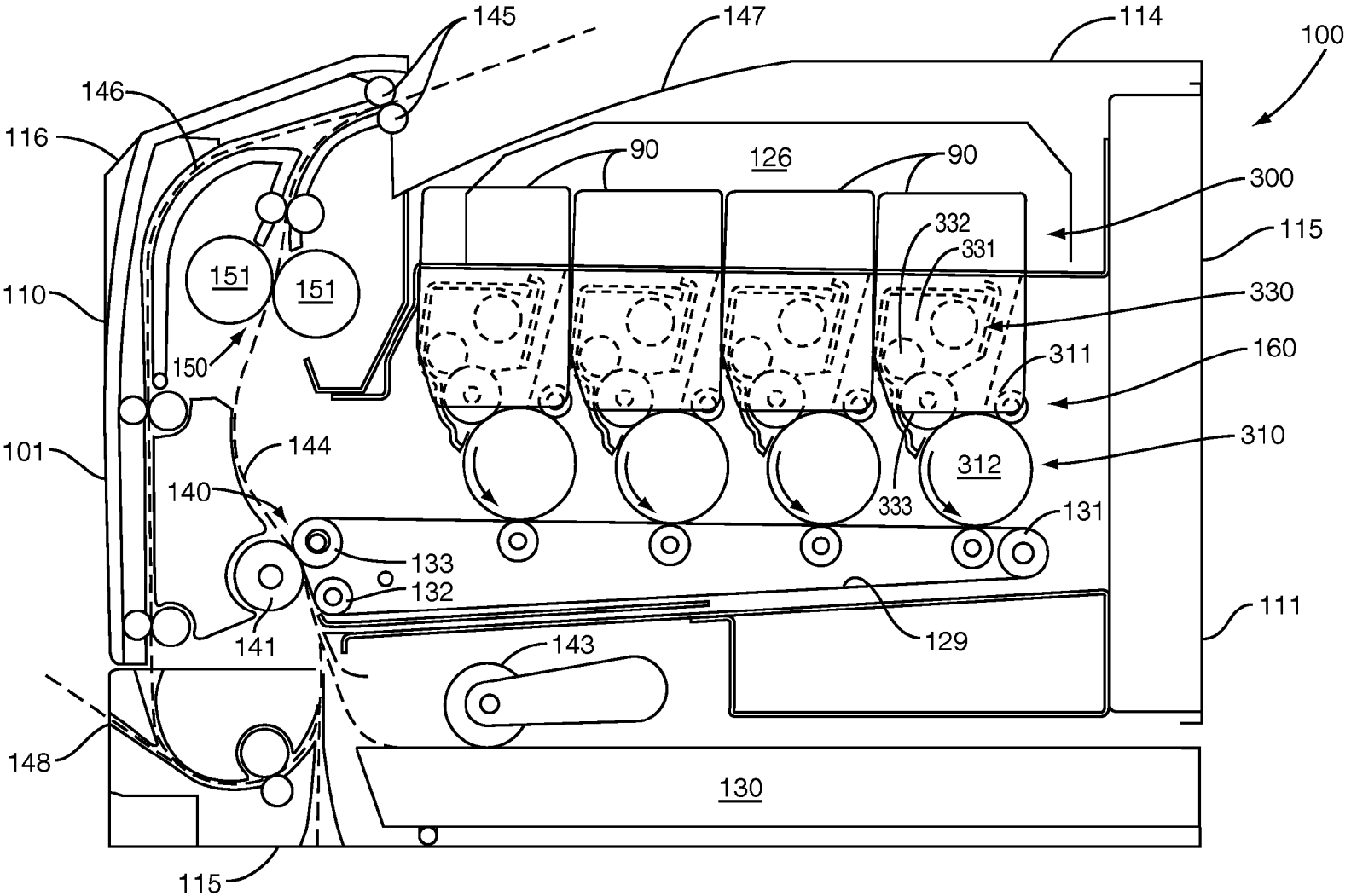
FIG. 2 is a schematic view of an image forming device according to one embodiment.

FIG. 2 illustrates one embodiment of the elements for image formation within an image forming device 100. The device 100 includes a media input tray 130 positioned in a lower section of a body 101. The tray 130 is sized to contain a stack of media sheets that will receive color and/or monochrome images. The media input tray 130 is preferably removable for refilling. The control panel 116 may be located on the front 110 of the body 101. Using the control panel 116, the user is able to enter commands and generally control the operation of the image-forming device 100. For example, the user may enter commands to switch modes (e.g., color mode, monochrome mode), view the number of images printed, take the device 100 on/off line to perform periodic maintenance, and the like.

A first toner transfer area 160 includes one or more imaging stations 300 that are aligned horizontally extending from the front 110 to the back 111 of the body 101. Each imaging stations 300 includes a photoconductor unit 310 and a developer unit 330. Each of the imaging stations 300 is mounted such that photoconductive (PC) drums 312 are substantially parallel. For purposes of clarity, the units 310, 330 are labeled on only one of the imaging stations 300. In one embodiment, each of the imaging stations 300 is substantially the same except for the color of toner.

The developer unit 330 includes a toner reservoir 331 to contain the toner. One or more agitating members may further be positioned within the reservoir 331 to move the toner. Developer unit 330 further includes a toner adder roll 332 that moves the toner supplied from the reservoir 331 to a developer roll 333. The photoconductor unit 310 includes in part a charging roll 311 and a PC drum 312. The units 310, 330 include additional elements that are explained below with reference to FIG. 3.

The charging roll 311 forms a nip with the PC drum 312, and charges the surface of the PC drum 312 to a specified voltage such as −1000 volts, for example. A laser beam from a printhead 126 is directed to the surface of the PC drum 312 and discharges those areas it contacts to form a latent image. In one embodiment, areas on the PC drum 312 illuminated by the laser beam are discharged to approximately −300 volts. The developer roll 333, which also forms a nip with the PC drum 312, then transfers toner to the PC drum 312 to form a toner image. The toner is attracted to the areas of the PC drum 312 surface discharged by the laser beam from the printhead 126.

An intermediate transfer mechanism (ITM) 129 is disposed adjacent to each of the imaging stations 300. In this embodiment, the ITM 129 is formed as an endless belt trained about drive roll 131, tension roll 132 and back-up roll 133. During image forming operations, the ITM 129 moves past the imaging stations 300 in a clockwise direction as viewed in FIG. 2. One or more of the PC drums 312 apply toner images in their respective colors to the ITM 129. In one embodiment, a positive voltage field attracts the toner image from the PC drums 312 to the surface of the moving ITM 129.

The ITM 129 rotates and collects the one or more toner images from the imaging stations 300 and then conveys the toner images to a media sheet at a second transfer area. The second transfer area includes a second transfer nip 140 formed between the back-up roll 133 and a second transfer roll 141.

A media path 144 extends through the device 100 for moving the media sheets through the imaging process. Media sheets are initially stored in the input tray 130 or introduced into the body 101 through a manual feed 148. The sheets in the input tray 130 are picked by a pick mechanism 143 and moved into the media path 144. In this embodiment, the pick mechanism 143 includes a roll positioned at the end of a pivoting arm. The roll rotates to move the media sheets from input tray 130 towards the second transfer area. In one embodiment, the pick mechanism 143 is positioned in proximity (i.e., less than a length of a media sheet) to the second transfer area with the pick mechanism 143 moving the media sheets directly from the input tray 130 into the second transfer nip 140. For sheets entering through the manual feed 148, one or more rolls are positioned to move the sheet into the second transfer nip 140.

The media sheet receives the toner image from the ITM 129 as it moves through the second transfer nip 140. The media sheets with toner images are then moved along the media path 144 and into a fuser area 150. Fuser area 150 includes fusing rolls or belts 151 that form a nip to adhere the toner image to the media sheet. The fused media sheets then pass through exit rolls 145 that are located downstream from the fuser area 150. Exit rolls 145 may be rotated in either forward or reverse directions. In a forward direction, the exit rolls 145 move the media sheet from the media path 144 to an output area 147. In a reverse direction, the exit rolls 145 move the media sheet into a duplex path 146 for image formation on a second side of the media sheet.

Figure 3:
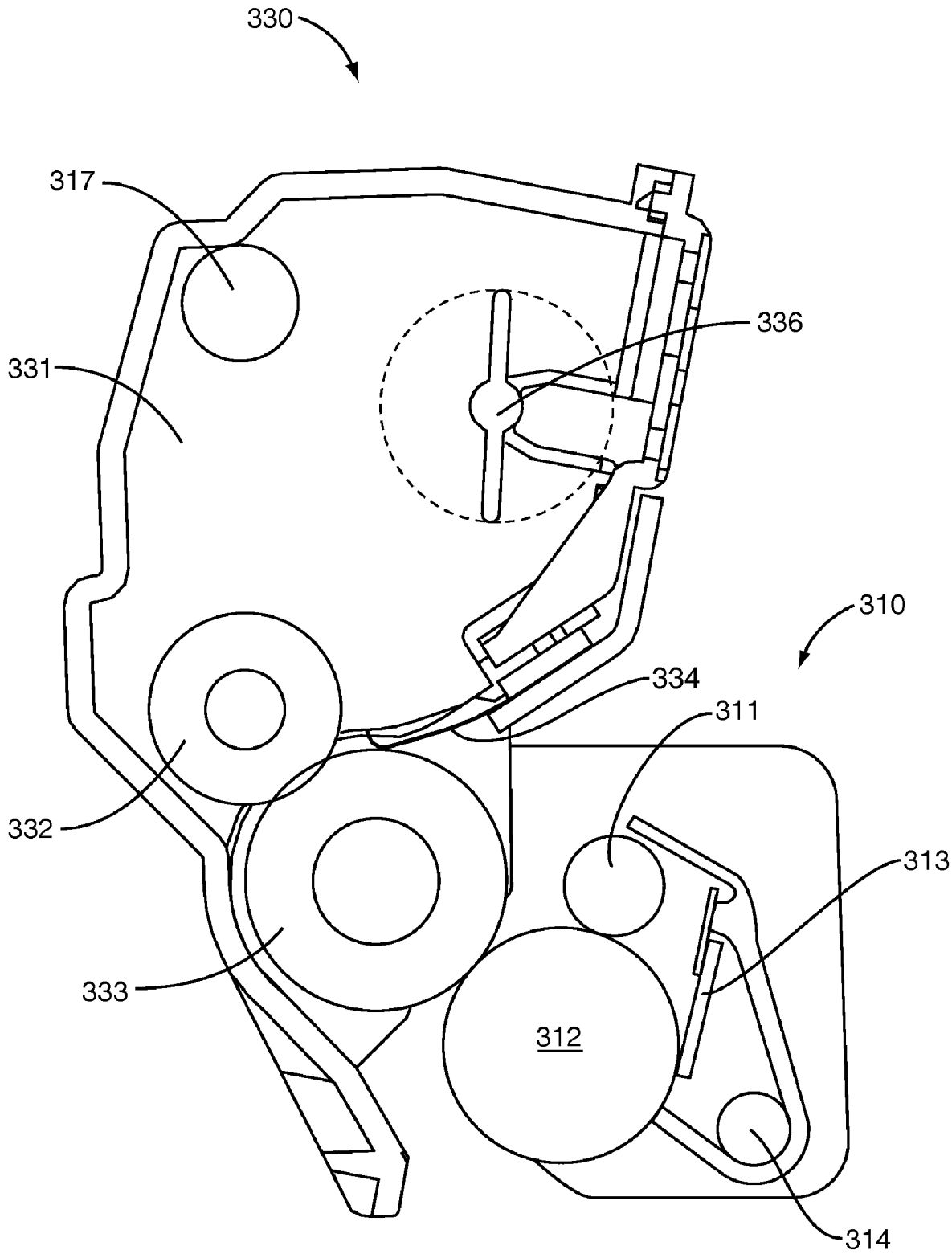
FIG. 3 is a section view of a developer unit and photoconductor unit according to one embodiment.

FIG. 3 illustrates one embodiment of the photoconductor unit 310 and the developer unit 330. The photoconductor unit 310 includes the PC drum 312, charging roll 311, and a cleaner blade 313. The photoconductor unit 310 may further include an auger 314 that moves the waste toner removed by the cleaner blade 313 to a waste toner reservoir within a body 101 of the image forming device as will be explained in more detail below. The developer unit 330 includes the reservoir 331 to store the toner, the developer roll 333, and the toner adder roll 332. In addition, a doctor blade 334 abuts against the surface of the developer roll 333 to control the amount of toner that adheres to the roll. Further, a toner agitating member may further be positioned within the reservoir 331 to agitate and move the toner.

In one embodiment as illustrated in FIG. 3, the photoconductor unit 310 and developer unit 330 are connected together as a single unit. One or more springs (not illustrated) may be positioned to maintain the developer roll 333 of the developer unit 330 in contact with the PC drum 312 in the photoconductor unit 310. The units 310, 330 may be separated from one another to be individually removed from the image forming device 100 and replaced as necessary. By way of example, one or more of the elements in the developer unit 330 may be worn out after a certain number of printed pages. The developer unit 330 may be removed and replaced with a new unit without requiring replacement of the photoconductor unit 310 which may still have a useful life.

Figure 4:
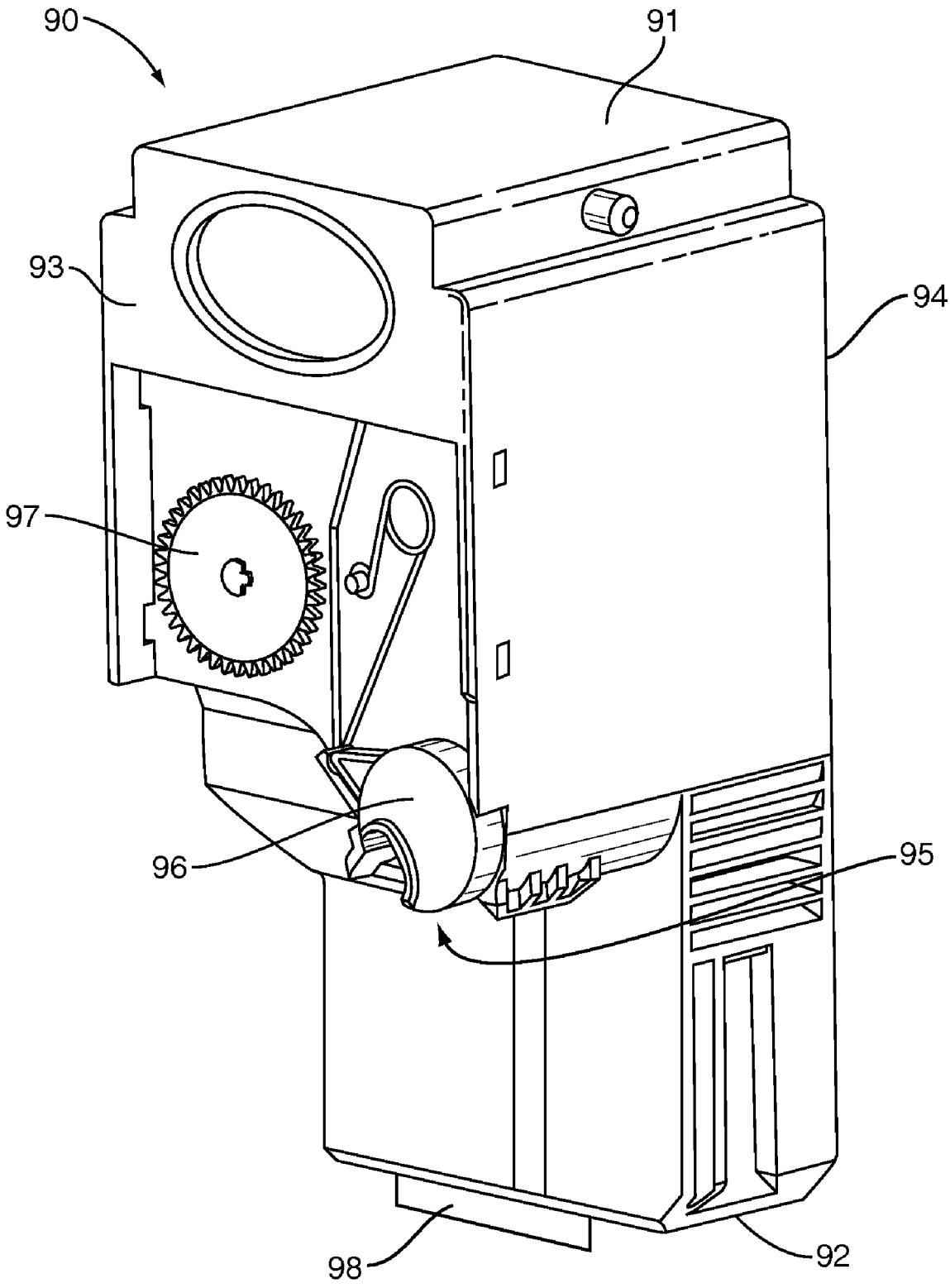
FIG. 4 is a perspective view of a toner cartridge according to one embodiment.

The imaging unit 350 may also include a toner cartridge 90 to supply toner to the developer unit 330. FIG. 4 illustrates one embodiment of a toner cartridge 90 that can be operatively connected to the developer unit 330. Toner cartridge 90 includes a top side 91, bottom side 92, first side 94, and second side 93. Toner is stored within the interior and is expelled through an outlet 95 that extends through the second side 93. A shutter 96 is positioned within the outlet 95 to control the movement of toner. Shutter 96 may be rotated between a closed orientation to prevent toner movement and an open orientation to allow toner to move through the outlet 95 and into an inlet 317 in the developer unit 330. A gear 97 is positioned on the second side 93 and engages with a corresponding gear on the developer unit 310. Gear 97 is operatively connected to members within the interior to agitate and move the toner through the outlet 95.

In one embodiment, an electrical connector 98 is positioned at the bottom side 92 and engages with a connector in the body 101 or in the imaging unit 350. Electrical connector 98 may be associated with computing hardware for storing parameters including but not limited to pages printed, toner color, first use date, and toner cartridge. The computing hardware may include one or more processors, logic devices, and memory. The computing hardware may further comprise integrated circuits, including for example application specific integrated circuits and digital signal processors, in which embedded program code may be stored and executed.

Examples of toner cartridges are disclosed in U.S. patent application Ser. Nos. 11/554,157 and 11/554,117 each filed on Oct. 30, 2006, and Ser. No. 11/556,863 filed on Nov. 6, 2006, each of which are incorporated herein by reference.

Figure 5A:
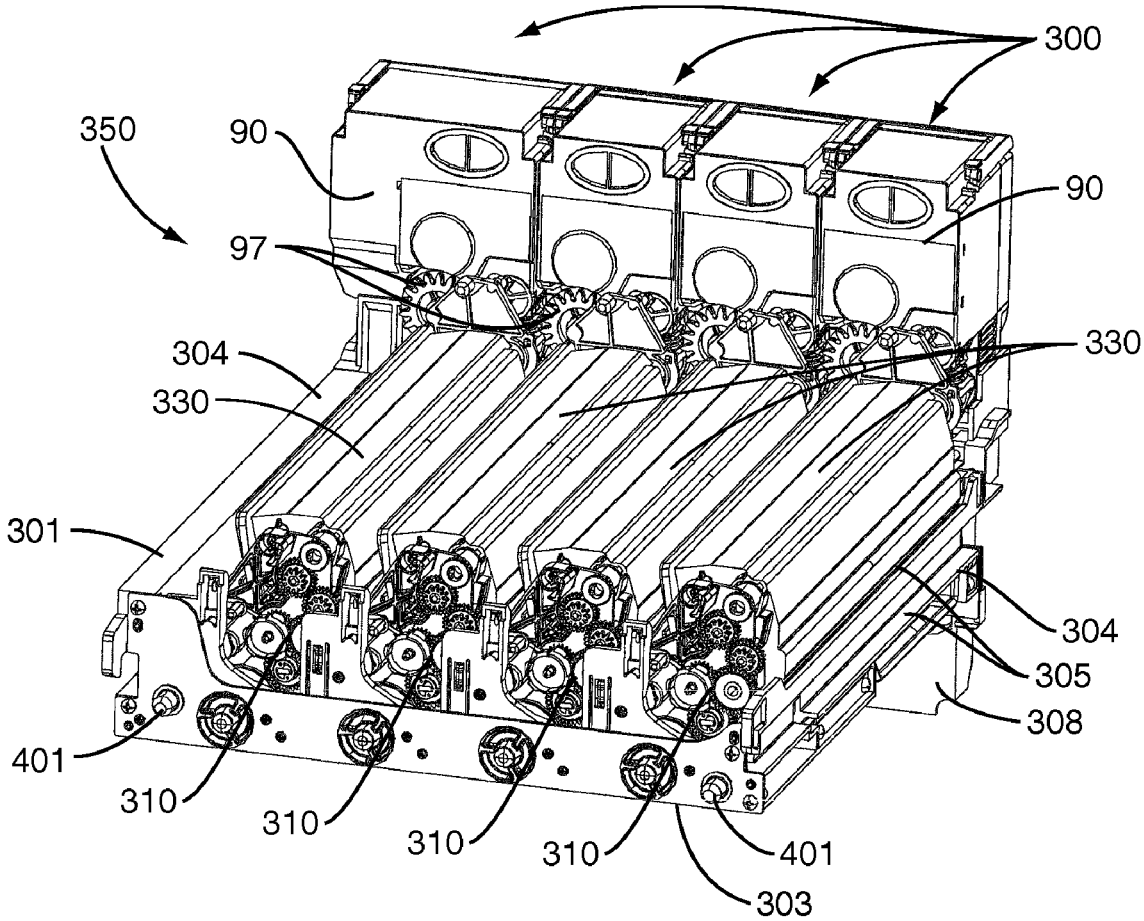
FIG. 5A is a perspective view of a first side of an imaging unit according to one embodiment.
Figure 5B:
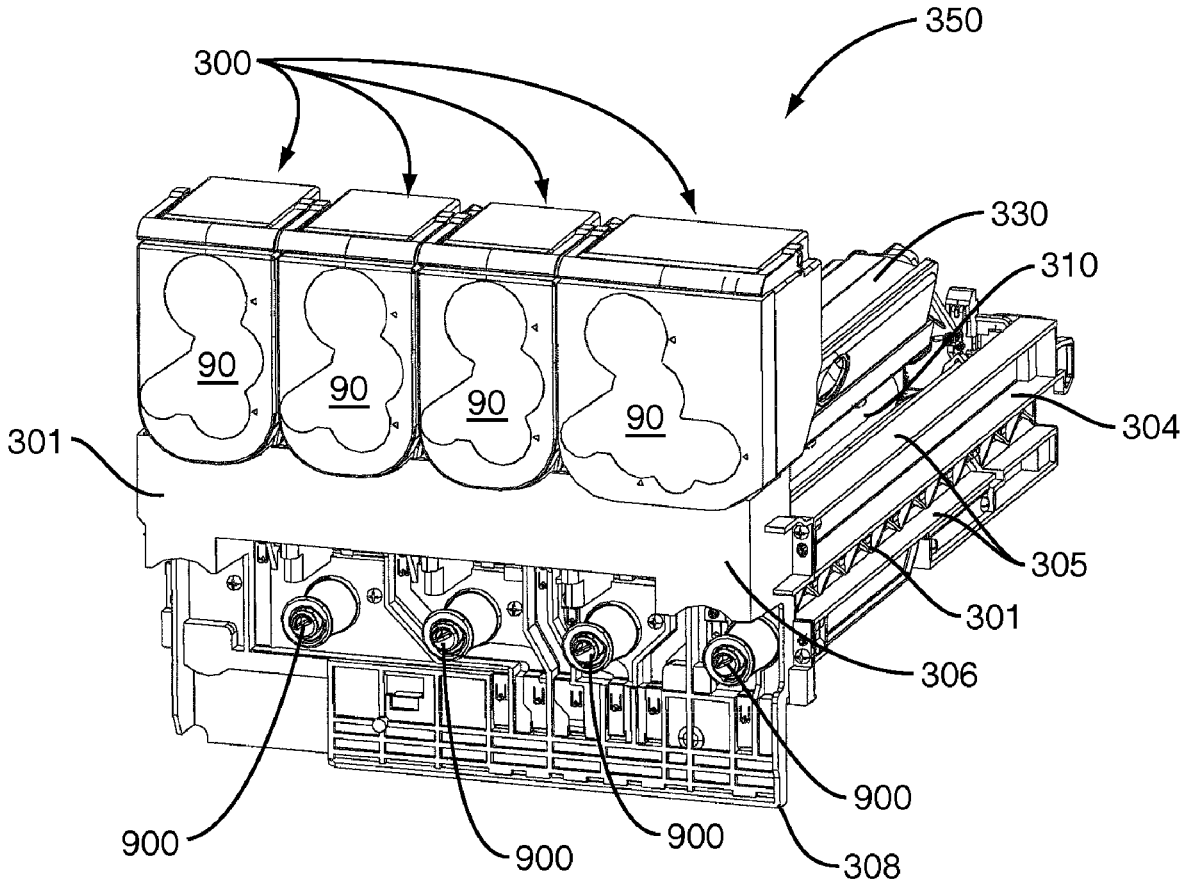
FIG. 5B is a perspective view of a second side of an imaging unit according to one embodiment.

As previously explained, two or more imaging stations 300 are mounted together to form the imaging unit 350. FIGS. 5A and 5B illustrate an imaging unit 350 that includes four imaging stations 300 that each includes a photoconductor unit 310, developer unit 330, and a toner cartridge 90. The imaging unit 350 includes a frame 301 sized to receive each of the imaging stations 300. Frame 301 includes a substantially rectangular shape formed by opposing first and second brace members 302, 303 and lateral brace members 304. In one embodiment, the brace members 302, 303 are manufactured out of stamped metal plates that result in precise control of the location of the PC drums 332 relative to one another and relative to the ITM belt 129, laser assembly 126, and drive modules within the body 101. In one embodiment, brace members 304 are constructed of plastic. Frame 301 includes a central opening sized to receive the photoconductor units 310 and developer units 330. One or more guide rails 305 extend along the outer sides of the lateral brace members 304 and contact guides 102 (FIG. 1) during insertion of the imaging unit 350 into the body 101. As illustrated in FIG. 5B, frame 301 may also include a support member 306 on the first side.

Figure 5C:
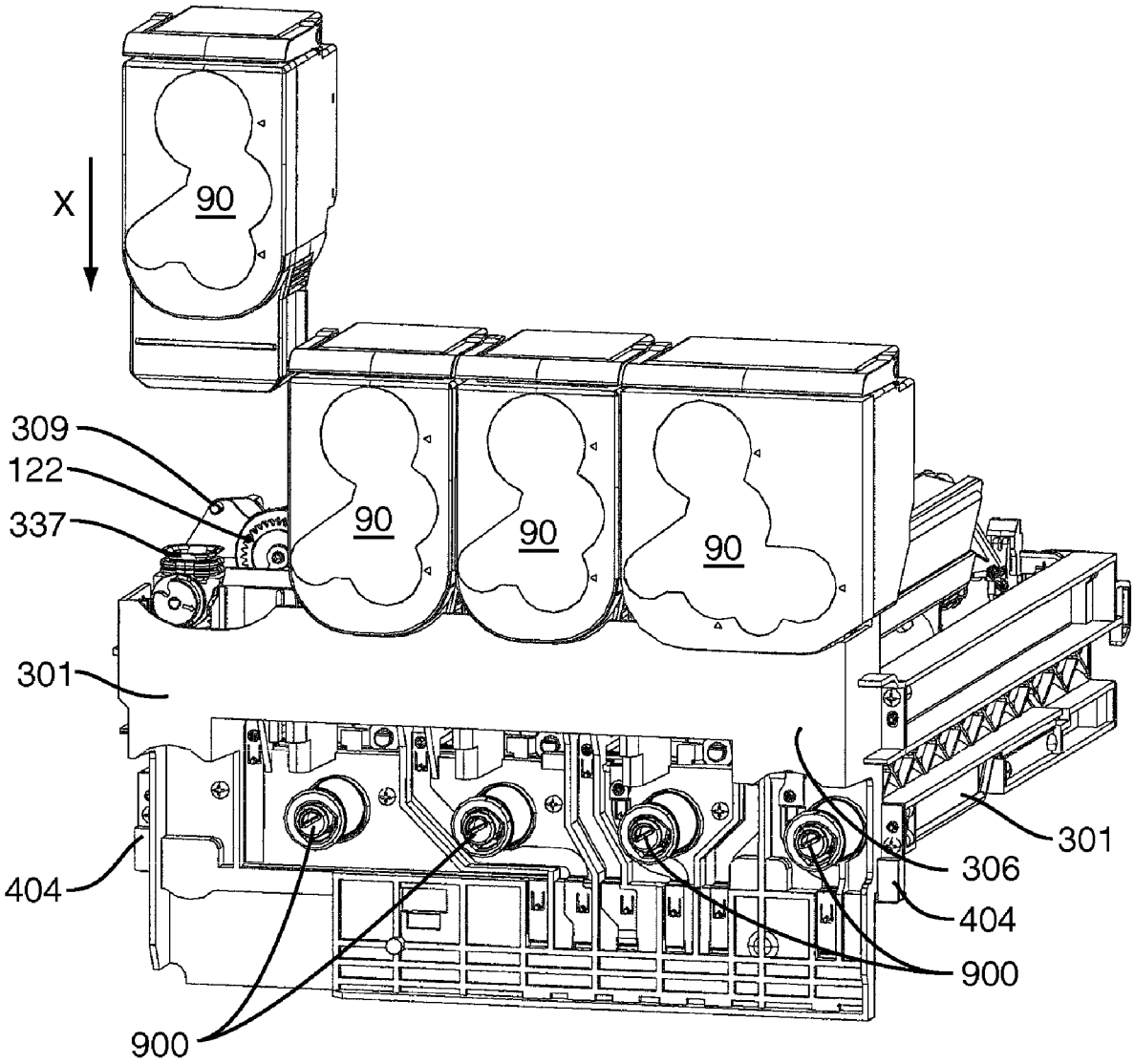
FIG. 5C is a perspective view of a second side of an imaging unit with a toner cartridge being inserted according to one embodiment.

In one embodiment as illustrated in FIG. 5C, the toner cartridges 90 are mounted to the frame 301 in a vertical direction X. Once fully seated, the electrical connector 98 is engaged with the corresponding connector in the body 101 or within the frame 301. Further, a pin 309 on the developer unit 310 is positioned to contact the outer edge of the shutter 96 (FIG. 4) and rotate the shutter 96 from the closed orientation to the open orientation as the toner cartridge 90 is being fully seated onto the frame 301. Once seated, the outlet 95 is aligned with a receptacle 337 in the developer unit 330 to receive the toner. Gear 97 (FIG. 4) on the second side 93 of the toner cartridge 90 further engages a corresponding gear 122 on the developer unit 310.

Figure 6:
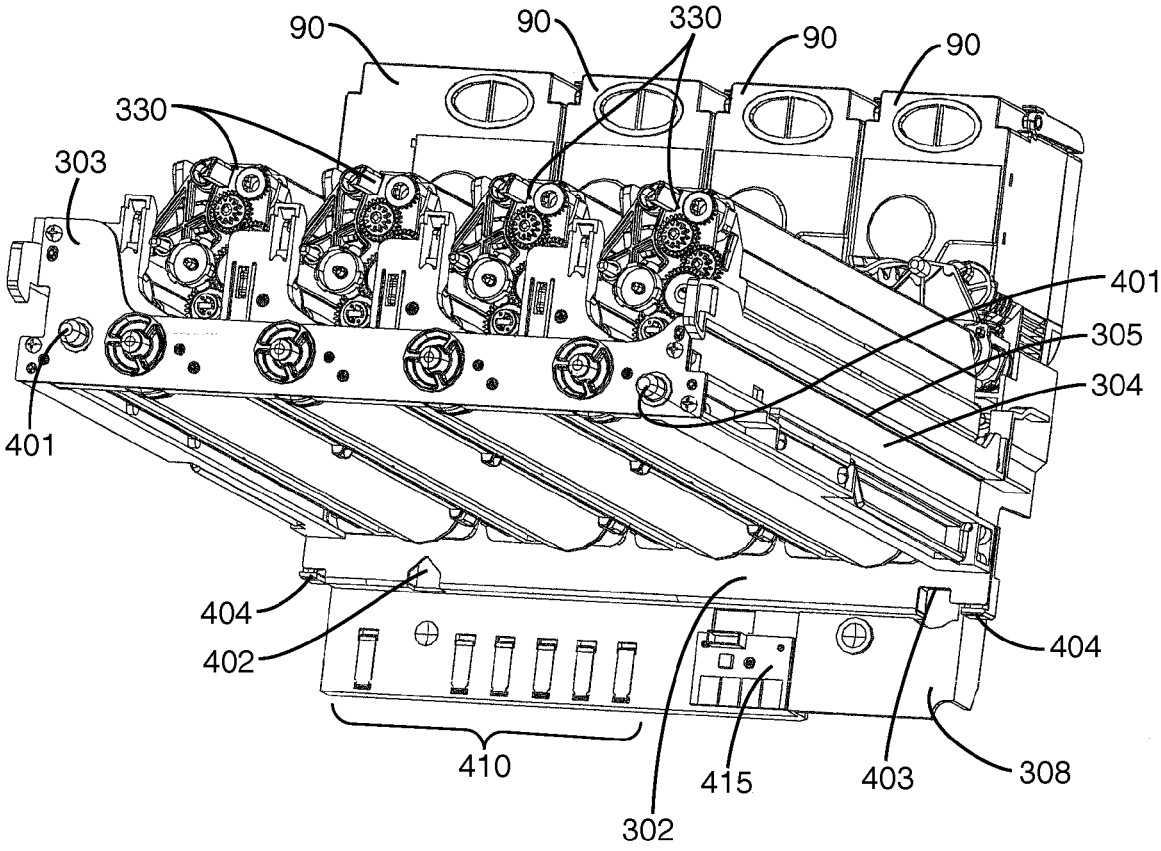
FIG. 6 is a perspective view of a first side of an imaging unit according to one embodiment.

As best illustrated in FIG. 6, an extension 308 is positioned at the first side of the frame 301. In one embodiment, the extension 308 is positioned vertically below the level of the brace members 302, 303, 304. One or more electrical contact traces 410 are positioned to contact with corresponding connectors in the body 101 during insertion of the imaging unit 350. The traces 410 provide voltage from the body 101 to each of the imaging stations 300. One or more electrical contacts 415 may also be positioned to contact corresponding members in the body 101 to allow data communication between the imaging stations 300 and the body 101.

The imaging unit 350 further includes various locating features for positioning during insertion into the body 101. As illustrated in FIGS. 5A and 6, the second brace member 303 includes a pair of outwardly-extending studs 401. Further, the brace member 302 includes a v-shape feature 402 and a flat feature 403. In one embodiment, studs 401 and features 402, 403 are space apart and positioned in proximity to the lateral sides of the imaging unit 350. The locating features 401, 402, 403 establish a four-point contact grid between the imaging unit 350 and the body 101. Additionally, contact points 404 are positioned on the brace member 302 to locate the imaging unit 350 laterally in the body 101.

The frame 301 may also include locating features to accurately position the PC drums 312 of the photoconductor units 310. In one embodiment, the PC drums 312 are mounted on a central shaft 319. As illustrated in FIGS. 7 and 8A-C, apertures 420 extend through the second brace member 303 to receive the shafts 319. Bushings 421 may be mounted in the apertures 420 and include an opening 426 to receive the shafts 319.

In one embodiment as illustrated in FIG. 8A, the bushing 421 includes a central opening 426 and a reduced diameter section 425 that extends through a circular aperture 420 and an increased diameter section 427 positioned against an outer face of the second brace member 303. In one embodiment, the bushings 421 are constructed of a flexible material and are press-fit into the apertures 420. FIG. 8B includes an embodiment with a circular aperture 420 in the second brace member 303. Bushing 421 includes sections 425 and 426 to mount to the second brace member 303 in the same manner as described above. Bushing 421 further includes an opening 426 with a circular upper portion and a V-shaped lower portion. The shaft 319 from the PC drum 331 rests against and is positioned by the V-shaped lower portion. FIG. 8C includes another embodiment with a donut-shaped bushing 421 with a circular opening 426. Aperture 420 includes a circular upper portion and a V-shaped lower portion. The bushing 421 is positioned within the V-shaped portion at the bottom of the aperture 420. The embodiment of FIG. 8C may also include an additional element (not illustrated) such as a plastic member part or a metal spring member, to ensure that the bushing 421 is biased down into the V-shaped lower portion.

A path to ground may be created by positioning of the PC drum shaft 319 within the aperture 420 in the second brace member 303. In one embodiment, the bushing 421 is constructed of an oil-impregnated sintered bronze material that forms a portion of the ground path.

Figure 9:
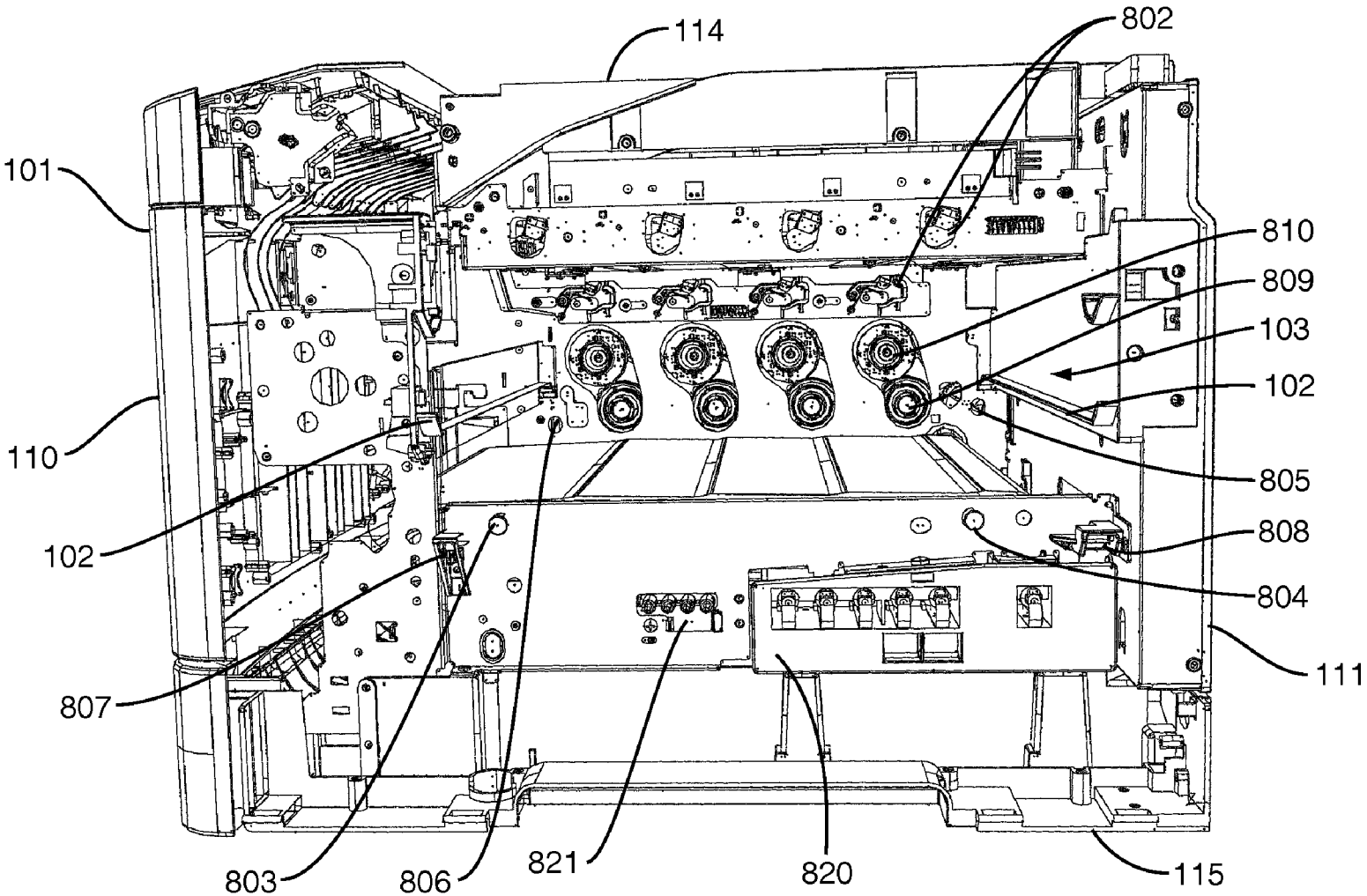
FIG. 9 is a perspective view of an interior of a body of an image forming device according to one embodiment.

The imaging unit 350 is positioned as a single assembly into the body 101. FIG. 9 illustrates the interior 103 of the body 101 that is sized to receive the imaging unit 350. Guide rails 102 extend along the edges of the interior 103. Guide rails 102 are sized and positioned to contact the corresponding guide rails 305 on the lateral sides 304 of the frame 301 during insertion and removal of the imaging unit 350. In one embodiment, the guide rails 305 ride along guide rails 102 during insertion and then detach when the imaging unit 350 is fully inserted into the body 101. This detachment provides for the imaging unit 350 to be accurately positioned by the locating features on the frame 301.

Locating studs 803, 804 are positioned towards a front section of the interior 103. Stud 803 is contacted by flat feature 403 (FIG. 6) and stud 804 by the V-shaped feature 402 each located on the brace member 302. Apertures 805, 806 are positioned on a far wall of the interior 103 to receive the studs 401 that extend outward from the second brace member 303 of the frame 301. Shelves 807, 808 are positioned towards the front section of the interior 103 to engage the contact points 404 on the extension 308 to locate the imaging unit 350 laterally in the body 101.

The near and far walls of the interior 103 may include hold-downs 802 that couple the imaging unit 350 to the body 101 and provide forces necessary for the internal function of the imaging unit 350. Sets of drive couplers 809, 810 may be positioned at the far wall and engage with each imaging station 300 respectively for transferring rotary motion to the photoconductor units 310 and developer units 330.

A high voltage electrical interface 820 is positioned to engage with the electrical traces 410 on the imaging unit 350. In one embodiment, the electrical interface 820 includes a single contact block with one or more contacts that interface with the traces 410. Data communication electrical contacts 821 are positioned to interface with the electrical contacts 415 for data communication between the imaging stations 300 and the body 101. In one embodiment, the electrical contacts 821 are reduced to a single contact block.

As illustrated in FIG. 1, a door 120 may be pivotally connected to the body 101. The door 120 is sized to extend across the opening after the insertion of the imaging unit 350 into the interior 103. Likewise, door 120 is pivoted to an open orientation to remove the imaging unit 350 from the interior 103.

Once the imaging unit 350 is mounted within the body 101, the toner cartridges 90 are aligned vertically under the door 121 on the top side 114. This positioning provides for the toner cartridges 90 to be vertically removed and replaced without removing the imaging unit from the body 101. As explained above with reference to FIG. 5C, the vertical insertion direction X engages the toner cartridge 90 with the imaging unit 350 and body 101 and provide for toner to move from the toner cartridge 90 and into the developer unit 330.

In one embodiment, each of the toner cartridges 90 is approximately the same shape and size. In another embodiment as illustrated in FIGS. 5A-C, one of the toner cartridges 90 is larger. The larger cartridge 90 is able to contain a larger amount of toner. In one embodiment, the black toner cartridge 90 is larger than the others because more black toner is normally used than the remaining toner colors of magenta, cyan, and yellow. This disproportionate usage may be further amplified when the image forming device 100 includes a black-only print mode with toner images only being printed from black toner. The non-black toner cartridges may be substantially identical.

Figure 10:
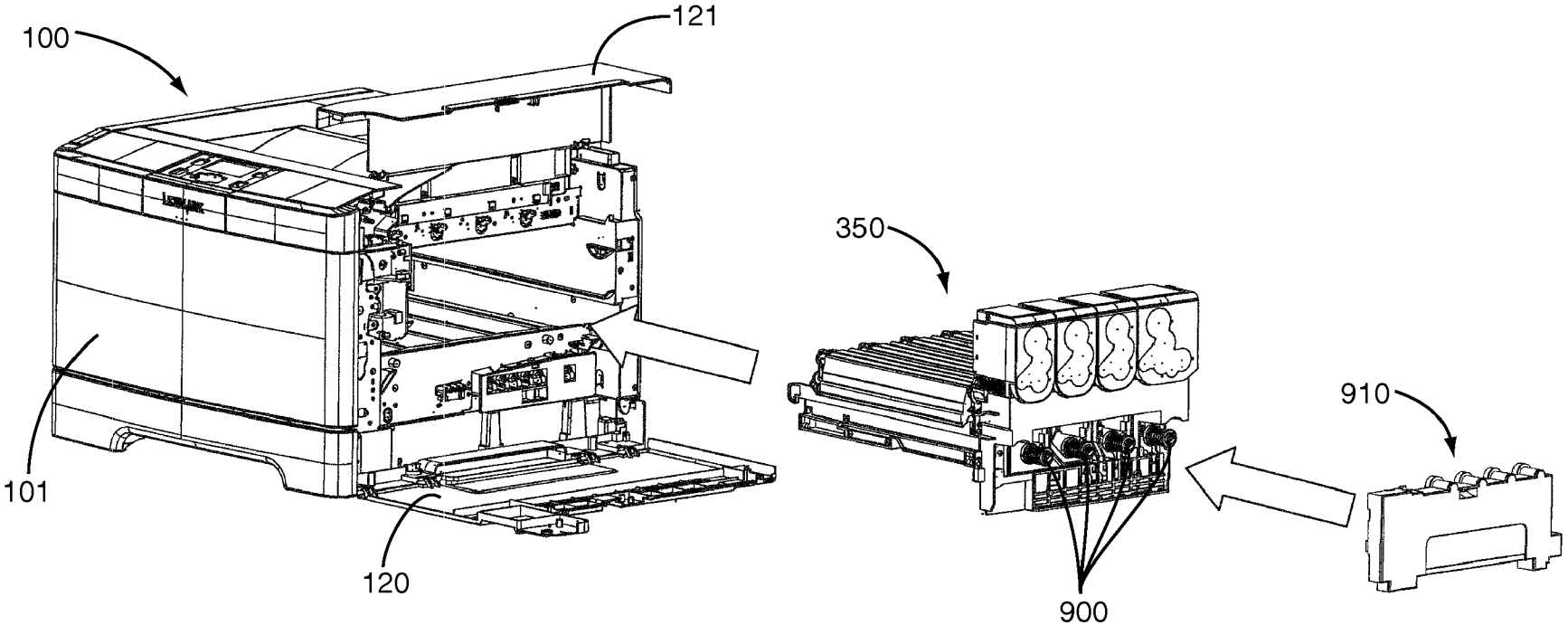
FIG. 10 is a perspective exploded view of an imaging unit, waste toner reservoir, and a body of an image forming device according to one embodiment.

As disclosed with reference to FIG. 3B, each photoconductor unit 310 includes a cleaner blade 313 that removes the waste toner from the surface of the PC drum 312. The waste toner moves into a housing and is moved by an auger 314 along the length of the PC drum 312. As illustrated in FIGS. 5B and 5C, the auger 314 moves the waste toner through waste toner ports 900 that extend outward from the first side of each of the photoconductor units 310. As illustrated in FIG. 10, a waste toner reservoir 910 is mounted to the body 101. Waste toner reservoir 910 includes inlets (not illustrated) that mate with each of the waste toner ports 900 to receive the waste toner. The waste toner reservoir 910 is positioned on the exterior of the imaging unit 350 and immediately inside the door 120 within the body 101. This placement provides for easy access, removal, and replacement once the waste toner reservoir 900 has become filled.

In one embodiment, the imaging stations 300 include independent photoconductor units 310 and developer units 330. These units may be separated from each other, and removed separately from the imaging unit 350. In another embodiment, the units 310, 350 are both contained within a single cartridge and cannot be separated from each other, or removed separately from the imaging unit 350.

As illustrated best in FIG. 5C, the toner cartridges 90 may be removed from the imaging unit 350 and the body 101 of the image forming device 100 as necessary. In one embodiment, removal of one or both of these elements initially requires the imaging unit 350 to be removed from the body 101. Removal of the developer units 310 and photoconductor units 330 may be necessary for repair and/or replacement.

The embodiments disclosed above are directed to image forming devices 100 with a secondary-transfer area. These devices include a first transfer of the toner image to an intermediate member, and a second transfer from the intermediate member to the media sheet. The present application may also be used in a direct transfer device that transfers the toner image directly to the media sheet (i.e., there is no intermediate member or second transfer).

Spatially relative terms such as "under", "below", "lower", "over", "upper", and the like, are used for ease of description to explain the positioning of one element relative to a second element. These terms are intended to encompass different orientations of the device in addition to different orientations than those depicted in the figures. Further, terms such as "first", "second", and the like are also used to describe various elements, regions, sections, etc and are also not intended to be limiting. Like terms refer to like elements throughout the description.

As used herein, the terms "having", "containing", "including", "comprising" and the like are open ended terms that indicate the presence of stated elements or features, but do not preclude additional elements or features. The articles "a", "an" and "the" are intended to include the plural as well as the singular, unless the context clearly indicates otherwise.

The present invention may be carried out in other specific ways than those herein set forth without departing from the scope and essential characteristics of the invention. In one embodiment, the guide rails 305 on the frame 301 are substantially parallel with the PC drums 312 in each of the imaging stations 300. In one embodiment, brace member 302 includes openings to receive a shaft from each of the PC members 312. In one embodiment, bushings are positioned in the openings in the brace member 302. The present embodiments are, therefore, to be considered in all respects as illustrative and not restrictive, and all changes coming within the meaning and equivalency range of the appended claims are intended to be embraced therein.

What is claimed is:

1. An imaging unit for an image forming device comprising:

a frame including outer brace members attached together to form a central opening, wherein the frame includes a substantially rectangular shape with first and second brace members that extend between a pair of lateral brace members;

a plurality of imaging stations mounted within the central opening, each of the plurality of imaging stations including a developer roll and a photoconductive (PC) member;

a plurality of locating features positioned on the frame to orient the frame within the image forming device;

an extension attached to the frame and extending downward below a bottom of the frame, the extension including electrical contacts that mate with the image forming device to provide electrical communication to each of the plurality of imaging stations; and guide rails positioned along each of the pair of lateral brace members for slidingly inserting the imaging unit into the image forming device, wherein each imaging station includes an outlet for discharging waste toner, and wherein the imaging unit further comprises a single waste toner reservoir positioned along an outside portion of the frame and having a plurality of openings to receive waste toner from each of the plurality of imaging units.

2. The imaging unit of claim 1, wherein two of the plurality of locating features extend outward from the first brace member and an additional two of the locating features are positioned along a bottom side of the second brace member.

3. The imaging unit of claim 1, further comprising openings positioned along the length of the first brace member and the second brace member to receive a shaft from each of the PC members.

4. The imaging unit of claim 3, further comprising a bushing positioned within each of the openings in the first brace member and the second brace member, each of the bushings being sized to be inserted into the openings and including an opening to reach the shaft.

5. The imaging unit of claim 1, wherein each imaging station comprises a toner cartridge separately removable from the developer roll and the PC member, and wherein the frame further includes a frame upper portion having one or more surface portions for receiving the toner cartridges thereon.

6. The imaging unit of claim 5, wherein for each imaging station, the PC member and the developer roll extend between opposed outer brace members in a first direction and the toner cartridges extend along the frame in a second direction orthogonal to the first direction.

* * * * *